US005605261A

United States Patent [19]

Berglund

[11] Patent Number: 5,605,261

[45] Date of Patent: Feb. 25, 1997

[54] LAUNDERED SHIRT STABILIZER

[76] Inventor: Stephen E. Berglund, 5128 N. Palm Ave., Fresno, Calif. 93704

[21] Appl. No.: 497,607

[22] Filed: Jun. 30, 1995

[51] Int. Cl.[6] ..... D06C 15/00

[52] U.S. Cl. ..... 223/84; 223/83; 223/81

[58] Field of Search ..... 223/84, 83, 82, 223/81, 52.1, 52.2, 52.3, 52.4, 72

[56] References Cited

U.S. PATENT DOCUMENTS

| | | | |
|---|---|---|---|
| 2,022,401 | 11/1935 | Brooks | 223/83 |
| 2,420,162 | 5/1947 | Baker | 223/84 |
| 2,864,540 | 12/1958 | Kass | 223/83 |
| 3,865,286 | 2/1975 | Tiss . | |
| 4,798,293 | 1/1989 | Carstens | 206/495 |

FOREIGN PATENT DOCUMENTS

| | | | |
|---|---|---|---|
| 1426657 | 12/1966 | France | 223/84 |
| 405771 | 2/1934 | United Kingdom | 223/84 |

*Primary Examiner*—Bibhu Mohanty
*Attorney, Agent, or Firm*—Mark D. Miller

[57] ABSTRACT

A convenient disposable flat collar blank having an arcuate upper portion attached to an enlarged lower portion for keeping a freshly laundered shirt in a desired configuration, avoiding wrinkles and/or preventing creases. The back surface of the blank bears a pressure sensitive adhesive. A removable backing material is provided to cover the adhesive until the blank is put into use. The upper arcuate portion defines two elongated fingers for adhesive attachment to the neckband of a shirt under the collar in alignment with the seam of the neck of the shirt. The lower portion is adhesively engaged with the shirt over the uppermost region of the front placket, usually covering over the top button, with room for a display. An optional cuff piece may also be provided which includes a second arcuate blank, without disk, having pressure sensitive adhesive on one for adhesive attachment to the insides of the open cuffs of a freshly laundered shirt to hold the cuffs, and hence the sleeves, of the shirt together to avoid unnecessary creasing or wrinkles.

2 Claims, 3 Drawing Sheets

LAUNDERED SHIRT STABILIZER

BACKGROUND OF THE INVENTION

1. Field of the Invention

The present invention relates to shirts, and in particular to a disposable adhesive collar and cuff attachment employed to retain laundered shirts in a desired configuration after laundering and until they are worn.

2. Description of the Prior Art

Different methods have been employed in shirt laundering to help stabilize a freshly laundered shirt in order to maintain its crisp, pressed appearance and avoid creases and wrinkles. Among currently employed methods are straight or safety pins, metal or plastic clips, folded cardboard pieces, staples and nylon threads. These devices are attached to the collar and/or sleeve cuffs of the shirt in order to keep the shirt from opening or inadvertently falling from a support hanger. Metal components such as pins, clips or staples suffer from the serious drawback of possibly discoloring the shirt from rust if they become wet or damp. Pins and staples can leave holes in the shirt, and have sharp ends which must be handled carefully in order to avoid puncture wounds. Plastic clips do not attach as firmly as pins or staples, but although less hazardous they have a greater tendency to become loosened or detached, or to break.

At least two different types of cardboard shirt collar stays are known in the art. The first is in the form of a rigid rectangular collar shaping piece having a generally T-shaped upper section hingedly attached at the bottom of the "T" to a generally U-shaped lower section. In use, the horizontal top of the "T" is folded over the top button into the inside of a shirt collar, and the two vertical sides of the "U" are placed under the shirt collar on either side. Unfortunately, such a shaping piece, even if made of sturdy cardboard, is susceptible to easy dislodgement, as well as tearing along the folded hinges. It is not likely to stay in place or provide the necessary support if there is any substantial movement of the shirt itself. No support for the sleeves is provided at all.

The other known cardboard collar stay is described in U.S. Pat. No. 3,865,286. It consists of a flat generally H-shaped piece having V-shaped upper and lower notches, with adhesive on one of the flat surfaces covered by a removable backing. After removing the backing, the lower notch is engaged with the uppermost shirt button and the upper legs are attached via adhesive to the undersides of the collar lapels. This collar stay requires that the shirt have a lapel and an upper button in close proximity with the collar, and that such button on the shirt be buttoned closed. Many tuxedo shirts have small collar lapels, or none at all, making this type of stay unusable. Many other shirts have no upper button, and for those that do, it is time consuming and cumbersome to engage such a button before attaching such a collar stay. Also, such a stay will move around the button. Finally, this collar stay provides only a very small area for engagement to the collar itself which may easily be dislodged. No support for the sleeves is provided at all.

SUMMARY OF THE INVENTION

The present invention overcomes each of the above described drawbacks by providing a convenient disposable flat collar attachment, or blank, having an arcuate upper portion attached to an enlarged lower portion. Both portions have a back surface bearing a pressure sensitive adhesive. A removable backing material is provided to cover the adhesive until the invention is put into use. The upper arcuate portion defines two elongated fingers which are placed in adhesive engagement with the neckband of the shirt in alignment with the seam of the neck of the shirt. The lower portion is adhesively engaged with the shirt over the uppermost region of the front placket, usually covering over the top button. The lower portion provides support for the fingers which hold the shirt collar in place.

An optional cuff piece may also be provided which includes a second arcuate blank, without the lower portion, having pressure sensitive adhesive on one side with removable backing. The cuff attachment is designed to for adhesive attachment to the insides of the open cuffs of a freshly laundered shirt to hold the cuffs, and hence the sleeves, of the shirt together to avoid unnecessary creasing or wrinkles.

The front surface of the lower portion of the collar attachment, as well as the entire front surface of the cuff attachment are available for printing appropriate use instructions or advertising material.

It is therefore a primary object of the present invention to provide a convenient disposable adhesive collar attachment for keeping the collar of a freshly laundered shirt in a desired configuration.

It is a further important object of the present invention to provide the combination of an adhesive shirt collar attachment and adhesive shirt sleeve cuff attachment for holding the collar and cuffs of a freshly laundered shirt in a desired configuration.

It is a further important object of the present invention to provide a convenient disposable shirt collar support having adhesive on one side for temporary attachment to a freshly laundered shirt which leaves no adhesive residue when removed.

It is a further object of the present invention to provide a disposable adhesive shirt collar support having elongated fingers for attachment to a significant portion of the shirt neckband in order to hold the collar thereof in a desired configuration.

It is a further important object of the present invention to provide a disposable adhesive shirt collar support which helps prevent creasing, wrinkling or collapsing of the collar of a freshly laundered shirt.

It is a further important object of the present invention to provide the combination of a disposable adhesive shirt collar support and disposable adhesive shirt sleeve retainer which helps prevent creasing, wrinkling or collapsing of the collar, sleeves and cuffs of a freshly laundered shirt.

It is a further important object of the present invention to provide the combination of a disposable shirt collar support and disposable shirt sleeve retainer, each part having adhesive on one side for temporary attachment to a freshly laundered shirt which leaves no adhesive residue when removed.

Additional objects of the invention will be apparent from the detailed descriptions and the claims herein.

DETAILED DESCRIPTION OF THE DRAWINGS

Figure 2:
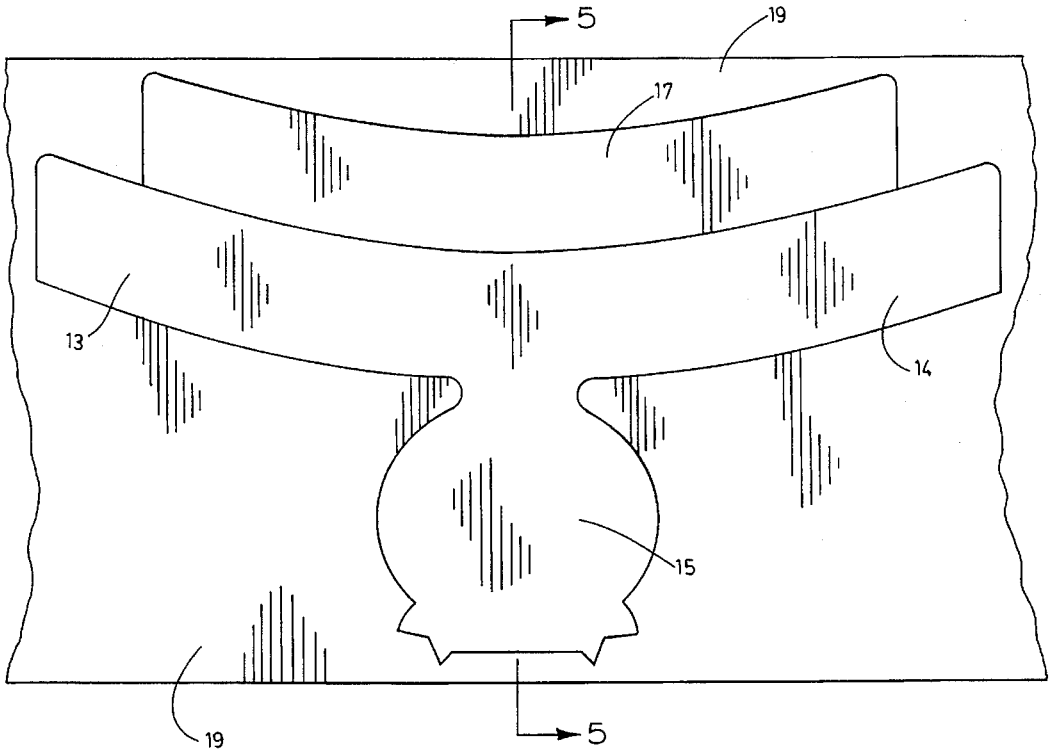
FIG. 2 is a front view of the collar and cuff parts of the present invention attached to a protective backing.
Figure 3:
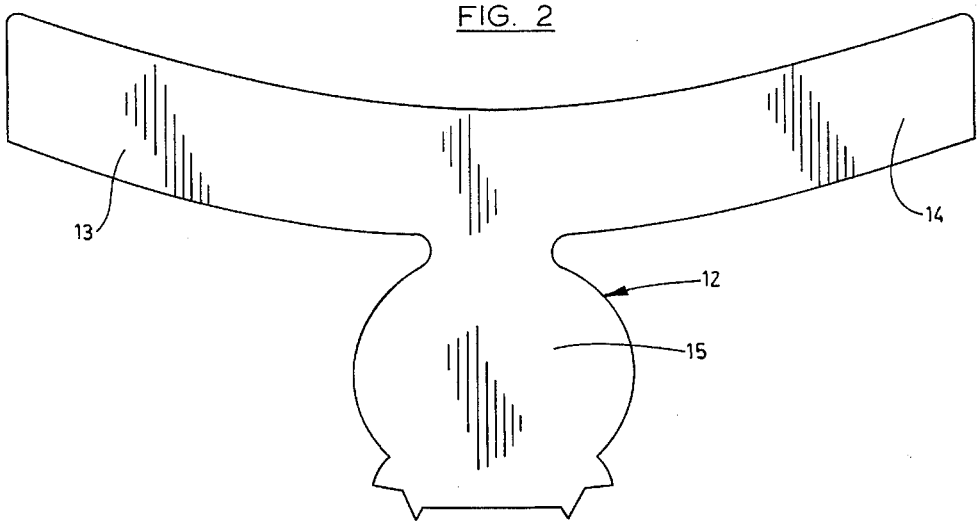
FIG. 3 is a front view of the collar attachment of the present invention.
Figure 4:
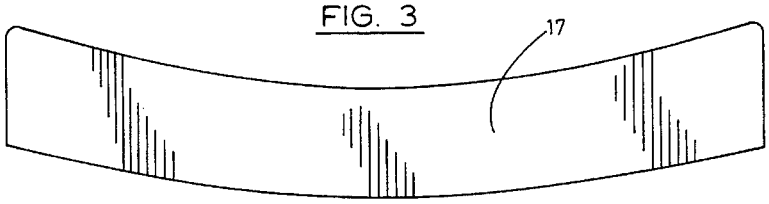
FIG. 4 is a front view of the cuff attachment of the present invention.
Figure 5:
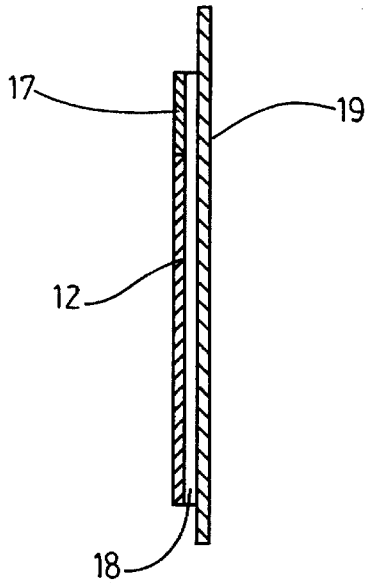
FIG. 5 is a cross sectional side view along line 5—5 of FIG. 2.

Referring to the drawings wherein like reference characters designate like or corresponding parts throughout the several views, and referring particularly to FIG. 3 it is seen that the invention includes a Y-shaped blank, generally 12, which includes an arcuate upper portion having left 13 and right 14 fingers. The fingers are attached to a lower region 15. The back surface of blank 12 is provided with an adhesive layer 18 having a protective backing 19 behind it (see FIGS. 2 and 5).

Figure 6:
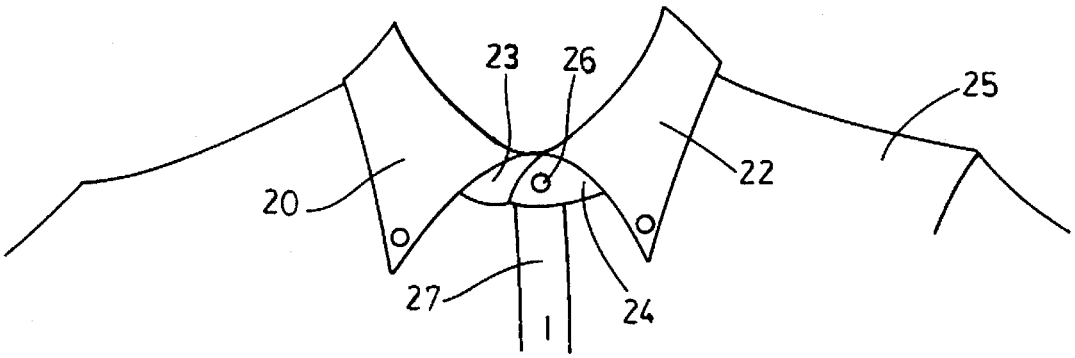
FIG. 6 is a front view of a typical shirt collar and neckband before application of the present invention.

In use, the protective backing 19 is removed from blank 12 exposing the adhesive layer 18. Left finger 13 is applied to the left side neckband 23 of a freshly laundered shirt 25 in line with the seam of the neck line. Similarly, right finger 14 is applied to the right side neckband 24 of shirt 25 in line with the right side seam. (Neither finger is attached to the underside of the collar 20, 22.) Region 15 is adhered over the upper portion of the shirt front placket 27 and over top button 26 (see FIGS. 1 and 6). Button 26 may or may not be closed before blank 12 is applied to the shirt. Fingers 13 and 14 are elongated in order to provide adhesion and support to nearly half of the diameter of the neck line. The large size of region 15 provides further support to fingers 13 and 14 as well as an exposed area for the printing of information, instructions or advertising.

Figure 1:
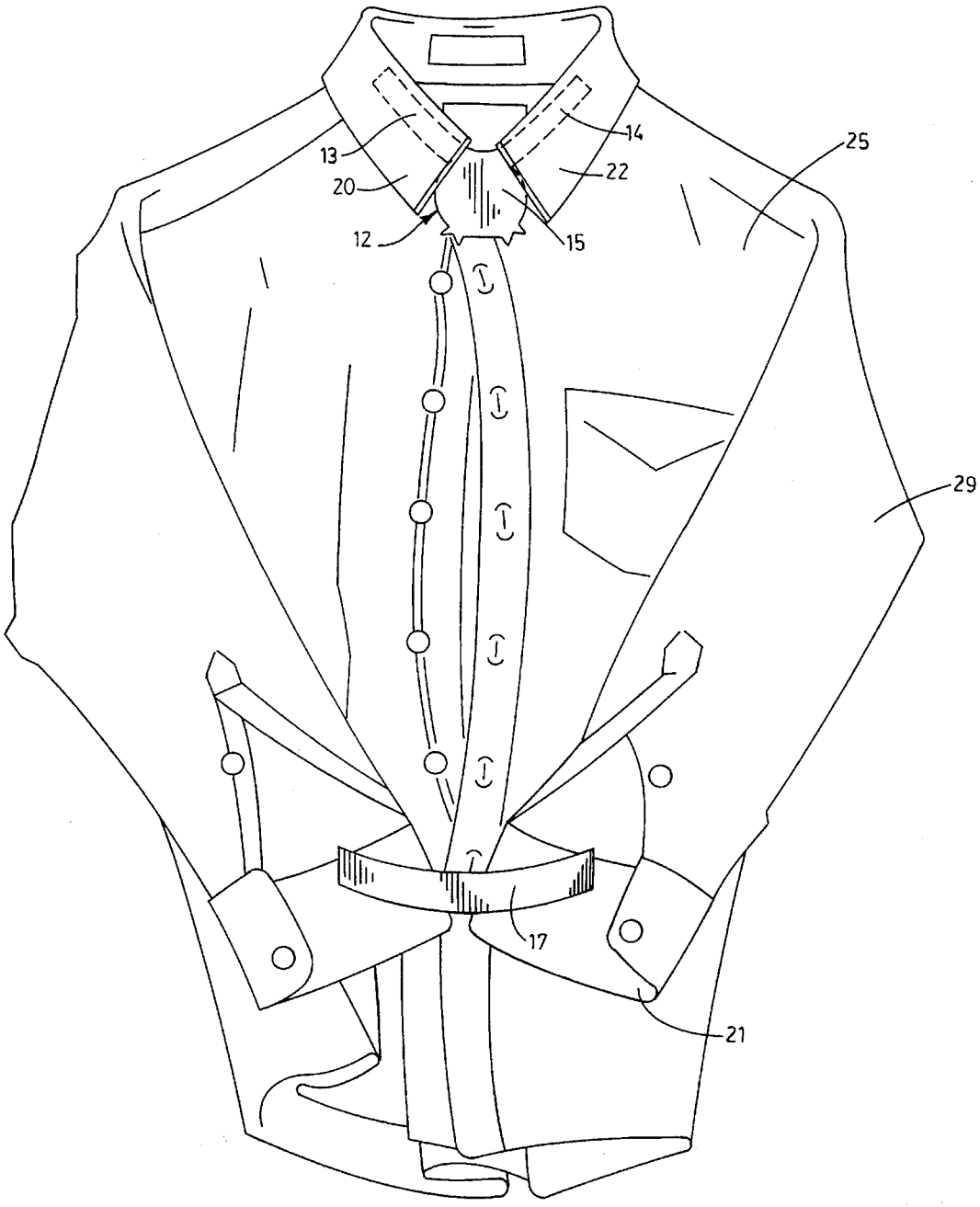
FIG. 1 is a perspective front view of a freshly laundered shirt upon which the collar and cuff parts of the present invention have been attached.

An optional sleeve retainer 17 is provided for holding the sleeve cuffs 21 together as shown in FIG. 1. As with the collar blank 12, retainer 17 has an adhesive layer 18 on the back surface which is protected by covering 19 until used.

DESCRIPTION OF THE PREFERRED EMBODIMENTS

In the preferred embodiment, the blank of the present invention is made of cardboard, paperboard, fiberboard, plastic or other sturdy but flexible material. The adhesive 18 should be of a type that adheres to fabric, but will not leave a residue thereon after removal. Backing 19 may be wax paper or other suitable material. Information, instructions and/or advertising may be printed on the front surfaces of blank 12 (especially region 15). Elongated fingers 13 and 14 should each be at least two inches (2") and preferably over three inches (3") in length.

In the alternative embodiment, a sleeve and cuff retainer 17 is provided. It should be made of the same material as blank 12, and can be manufactured along with blank 12 and attached to the same backing 19 as shown in FIG. 2.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A disposable shirt stabilizer kit comprising, in combination:

a first stiff yieldably flexible substantially Y-shaped flat paperboard blank having a front and back surface, an arcuate upper portion defining two generally horizontal elongated members centrally attached to a larger lower portion, said back surface being coated with a pressure sensitive adhesive material, wherein the two elongated members are adhesively attached to a shirt neckband underneath the collar and the lower portion is attached over the upper part of the front placket of said shirt in order to maintain said shirt collar in a desired configuration until it is worn; and a second stiff yieldably flexible flat generally horizontal arcuate paperboard blank having a front and back surface with pressure sensitive adhesive material on the back surface for attachment between the shirt sleeves in order to prevent the sleeves from wrinkling.

2. A disposable shirt stabilizer kit comprising, in combination:

a generally T-shaped flat paperboard blank having a pair of elongated generally horizontal slightly arcuate upper fingers attached at the center to an enlarged lower portion, the back surface having pressure sensitive adhesive material thereon, wherein said fingers are adhesively attached to a shirt neckband underneath the collar and the lower portion is attached over the upper part of the front placket of said shirt in order to maintain said shirt collar in a desired configuration until it is worn; and a second flat generally horizontal arcuate elongated paperboard blank having a front and back surface with pressure sensitive adhesive material on the back surface, for attachment between the shirt sleeves in order to prevent the sleeves from wrinkling.

* * * * *